US007857018B2

(12) United States Patent
Liu

(10) Patent No.: US 7,857,018 B2
(45) Date of Patent: Dec. 28, 2010

(54) CARRIER OF A WOOD PLANER FOR CARRYING A CUTTER AND A MOTOR

(75) Inventor: Chin-Yuan Liu, Taichung (TW)

(73) Assignee: Shinmax Industry Co., Ltd, Taichung Hsien (TW)

( * ) Notice: Subject to any disclaimer, the term of this patent is extended or adjusted under 35 U.S.C. 154(b) by 79 days.

(21) Appl. No.: 12/313,586

(22) Filed: Nov. 21, 2008

(65) Prior Publication Data

US 2009/0283660 A1 Nov. 19, 2009

(30) Foreign Application Priority Data

May 15, 2008 (CN) ..... 2008 2 0116204

(51) Int. Cl.
*B27C 1/00* (2006.01)

(52) U.S. Cl. ..... 144/114.1; 144/117.1

(58) Field of Classification Search ..... 144/114.1, 144/117.1, 128–130; 409/204, 219
See application file for complete search history.

(56) References Cited

U.S. PATENT DOCUMENTS 5,927,357 A * 7/1999 Welsh et al. ..... 144/130
5,957,173 A * 9/1999 Garcia ..... 144/117.1
6,089,287 A * 7/2000 Welsh et al. ..... 144/130
6,886,615 B2 * 5/2005 Wixey et al. ..... 144/117.1

* cited by examiner

*Primary Examiner*—Shelley Self
(74) *Attorney, Agent, or Firm*—Allston L. Jones; Peters Verny, LLP

(57) ABSTRACT

A light weight carrier movable along vertical guide posts of a wood planer includes left and right mounting seats having front and rear support blocks projecting oppositely and inwardly therefrom, front and rear guide holes adapted for extension of the guide posts, and cutter mounting holes each disposed between front and rear support blocks and between the front and rear guide holes, front and rear connecting rods each having left and right end sections respectively connected to the left and right mounting seats at the front and rear support blocks; a motor mounting plate fixed between the front support blocks; and a rear cover plate fixed between the rear support blocks.

10 Claims, 6 Drawing Sheets

CARRIER OF A WOOD PLANER FOR CARRYING A CUTTER AND A MOTOR

CROSS-REFERENCE TO RELATED APPLICATION

This application claims priority of Chinese Utility Model Application No. 200820116204.1 filed on May 15, 2008.

BACKGROUND OF THE INVENTION

1. Field of the Invention

The invention relates to a wood planer, more particularly to a carrier of a wood planer for carrying a motor and a cutter and for moving along vertical guide posts.

2. Description of the Related Art

Referring to FIGS. 1 and 2, a conventional wood planer 10 includes a frame body 11, four vertical guide posts 12 (only two are shown) fixed to the frame body 11, a carrier 13 movably mounted on the guide posts 12, a motor 14 mounted fixedly on the carrier 13, a cutter 15 mounted on the carrier 13 and driven by the motor 14, and a moving mechanism 16 for moving upward or downward the carrier 13 along the guide posts 12.

The carrier 13 includes two mounting seats 131 and an intermediate block 132 interconnecting the mounting seats 131. Generally, the carrier 13 is formed as a unitary body by casting. Thus, the entire weight of the carrier 13 is large, and a lot of material is required to manufacture the carrier 13, thereby increasing manufacturing costs.

SUMMARY OF THE INVENTION

Therefore, an object of the present invention is to provide a wood planer with a carrier that is of light weight and that can be manufactured at low costs.

According to this invention, a carrier is provided for use in a wood planer to carry a motor and a cutter and to move upward and downward along guide posts. The carrier comprises left and right mounting seats each having front and rear support blocks, front and rear guide holes, and a cutter mounting hole adapted for mounting the cutter and disposed between the front and rear support blocks and between the front and rear guide holes. The front and rear support blocks project oppositely and inwardly from the left and right mounting seats. The front and rear guide holes are adapted for extension of the guide posts. The carrier further comprises a front connecting rod having left and right end sections respectively connected to the front support blocks of the left and right mounting seats, a rear connecting rod having left and right end sections respectively connected to the rear support blocks of the left and right mounting seats, and a motor mounting plate disposed above the front connecting rod and having left and right ends respectively fixed to the front support blocks of the left and right mounting seats.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
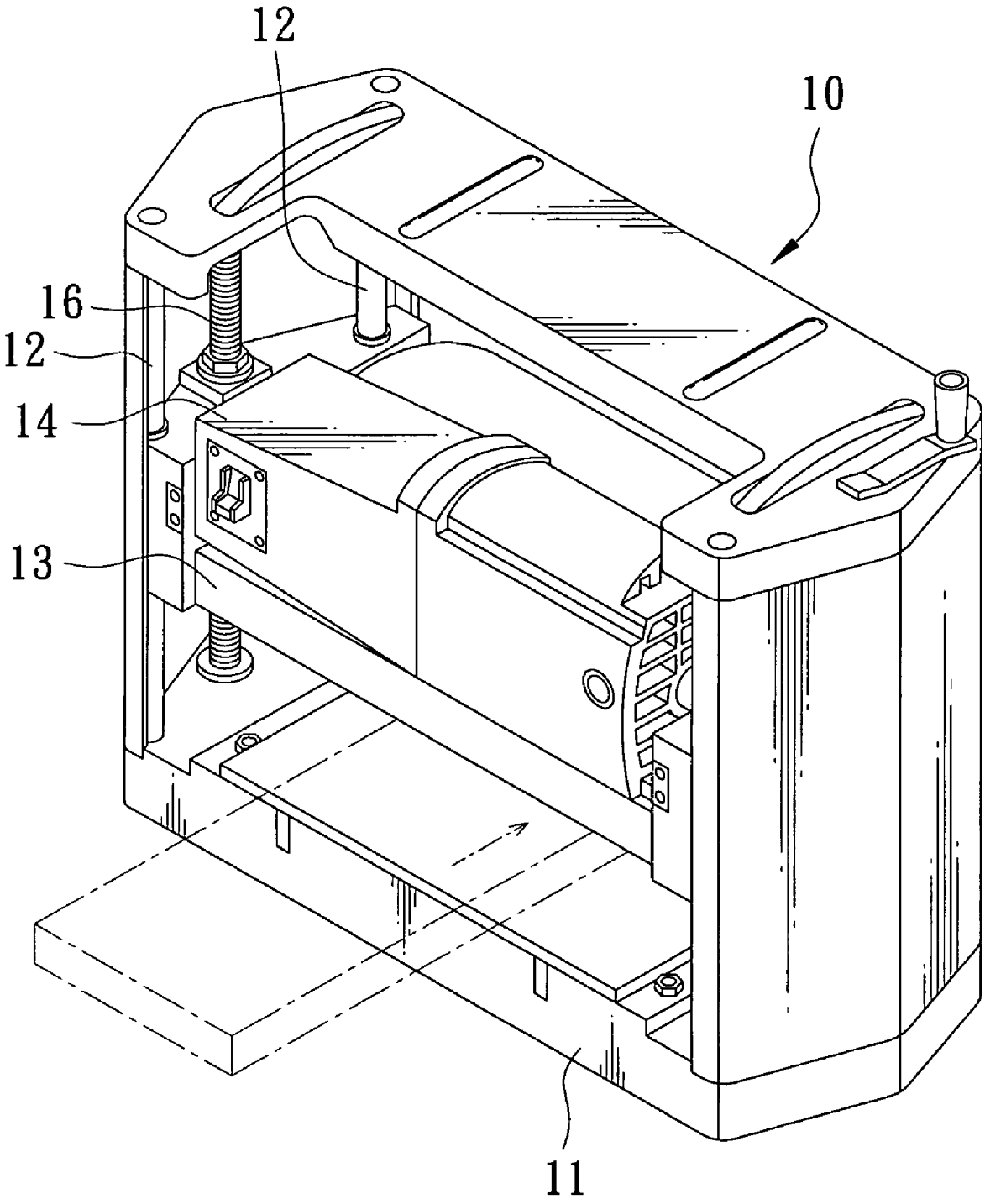
FIG. 1 PRIOR ART
FIG. 1 is a perspective view of a conventional wood planer.

Referring to FIGS. 3, 4, 5 and 6, a preferred embodiment of a carrier according to the present invention is shown at (A). The carrier (A) is used to carry a cutter (not shown) and a motor (not shown) of a wood planer, and is mountable on four vertical guide posts (not shown) of the wood planer, like the conventional carrier 13. The carrier (A) includes left and right mounting seats 2, front and rear connecting rods 4, a top connecting rod 5, a motor mounting plate 6 adapted to hold the motor, and a rear cover 7.

The left and right mounting seats 2 respectively have base portions 21 facing oppositely and extending in a top-to-bottom direction, top portions 22 extending in a left-to-right direction and projecting respectively and outwardly from top ends of the base portions 21, front portions 23 respectively projecting outward from front ends of the base portions 21 and connected to front ends of the top portions 22, and rear portions 24 respectively projecting outward from rear ends of the base portions 21 and connected to rear ends of the top portions 22. Front and rear support blocks 26, 27 project oppositely and inwardly from the front and rear portions 23, 24, respectively. The front and rear support blocks 26, 27 are elongated in a front-to-rear direction so that they further project respectively from portions of the base portions 21 adjacent to the front and rear portions 23, 24.

Each of the left and right mounting seats 2 further has front and rear guide sleeves 25 respectively defining front and rear guide holes 251 for extension of the guide posts (not shown). Each of the front and rear portions 23, 24 has a pair of the front or rear guide sleeves 25. A cutter mounting hole 28 is formed in the base portion 21 of each of the left and right mounting seats 2 between the front and rear support blocks 26, 27 and between the front and rear guide holes 251. The cutter mounting holes 28 are adapted to assemble a cutter (not shown) of the wood planer.

Each of the left and right mounting seats 2 further has two first insert holes 29, 30, and a second insert hole 33. The first insert hole 29 extends through the corresponding front support block 26 and the corresponding front portion 23. The first insert hole 30 extends through the corresponding rear support block 27 and the corresponding rear portion 24. The second insert hole 33 is defined by a tubular portion 32 projecting inwardly from a top lobe 31 that extends upward from a top end of the respective one of the left and right mounting seats 2.

Figure 5:
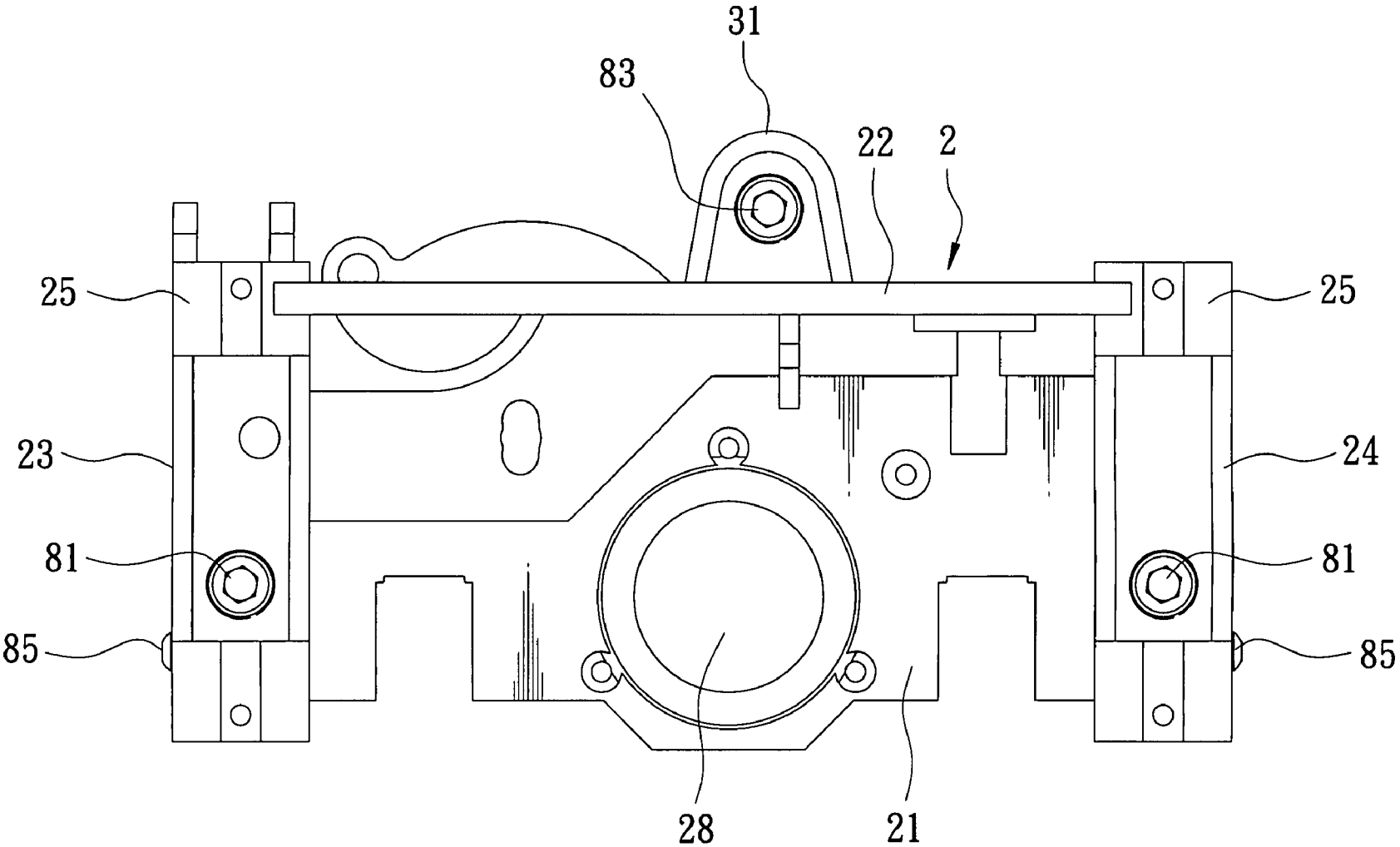
FIG. 5 is a side elevation view of the preferred embodiment.
Figure 6:
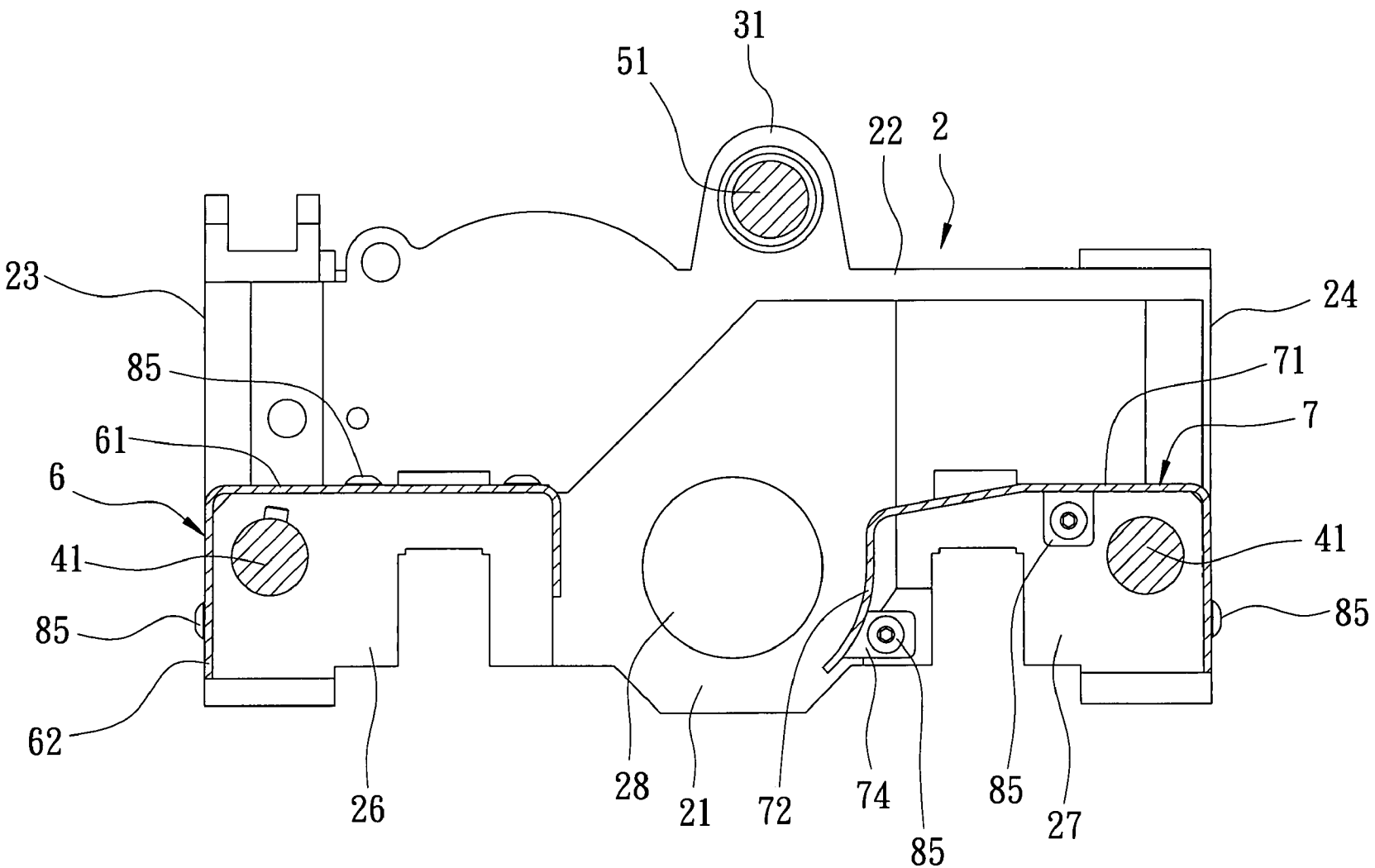
FIG. 6 is a sectional view taken along line VI-VI of FIG. 5.

The two front and rear connecting rods 4 are respectively disposed on two sides of the cutter mounting holes 28 and each have an intermediate section 41 connected to left and right end sections that are respectively connected to the left and right mounting seats 2. In particular, each of the left and right end sections of the front and rear connecting rods 4 is stepped, and has an end neck 42, a shoulder 421 adjacent to the end neck 42, a longitudinal screw hole 43 opening at an end of the end neck 42, a fastening screw 81, a transverse screw hole 44 disposed on one side of the shoulder 421 opposite to the end neck 42, and an abutment screw 82. The end neck 42 is insertable into one of the first insert holes 29, 30 of the left and right mounting seats 2. The fastening screw 81 is extendable into the longitudinal screw hole 43 and can abut against one of the front and rear portions 23, 24 as best shown in FIG. 5. The transverse screw hole 44 is communicated with the longitudinal screw hole 43. The abutment screw 82 is extendable transversely through the transverse screw hole 44 to abut against the fastening screw 81.

The intermediate section 41 of each of the front and rear connecting rods 4 has a rounded periphery between the left and right end sections thereof, and two transversely opposite recessed flat faces 45 (disposed at top and bottom sides of the periphery, only one is shown at the top side) formed in the rounded periphery. The front or rear connecting rod 4 may be clamped at the flat faces 45 by a clamping tool (not shown).

The top connecting rod 5 has left and right end sections which are stepped and each of which has an end neck 52 insertable into one of the second insert holes 33, a longitudinal screw hole 53, a transverse screw hole 54, a fastening screw 83, and an abutment screw 84. An intermediate section 51 of the top connecting rod 5 has two transversely opposite recessed flat faces 55.

The motor mounting plate 6 has left and right ends respectively seated on and fixed to the front support blocks 23 of the left and right mounting seats 2. The motor mounting plate 6 has a top plate portion 61 extending above the front connecting rod 4, a front plate portion 62 extending downwardly from the top plate portion 61 in front of the front connecting rod 4, and screw fasteners 85 for fastening the top and front plate portions 61, 62 to the front support blocks 23.

The rear cover plate 7 is disposed between the mounting seats 2 and fixed to the rear support blocks 27. The rear cover plate 7 includes a top plate portion 71 disposed above the rear connecting rod 4, a fence plate portion 72 extending downwardly from the top plate portion 71 in front of the rear connecting rod 4, a back plate portion 73 extending downwardly from the top plate portion 71 behind the rear connecting rod 4, first tabs 74 respectively and rearwardly projecting from two ends of the fence plate portion 72, second tabs 75 respectively and downwardly projecting from two ends of the top plate portion 71, and third tabs 731 respectively projecting from two ends of the back plate portion 73, and screw fasteners 85 to fasten the first, second and third tabs 74, 75, 731 to the rear support blocks 27.

In assembly, the left and right end sections of the front, rear and top connecting rods 4, 5 are respectively inserted into the first and second insert holes 29, 30, 33. The fastening screws 81, 83 are inserted respectively and threadedly into the longitudinal screw holes 43, 53 to fasten the left and right end sections of the front, rear and top connecting rods 4, 5 to the mounting seats 2. In order to stabilize the front, rear and top connecting rods 4, the abutment screws 82, 84 are respectively inserted into the transverse screw holes 44, 54 to abut against the respective fastening screws 81, 83, thereby preventing the fastening screws 81, 83 from vibration. During assembly, a clamping tool (not shown) may be used to clamp the front, rear, or top connecting rod 4, 5 to prevent the same from rotation by engaging the clamping tool with the recessed flat faces 45 or 55.

Afterwards, the motor mounting plate 6 is fixed to the front support blocks 26 by using the screw fasteners 85 to fasten the top plate portion 61 and the front plate portion 62 to the front support blocks 26. The rear cover plate 7 is fixed to the rear support blocks 27 by using the screw fasteners 85 to fasten the first, second and third tabs 74, 75, 731 to the rear support blocks 27.

Figure 2:
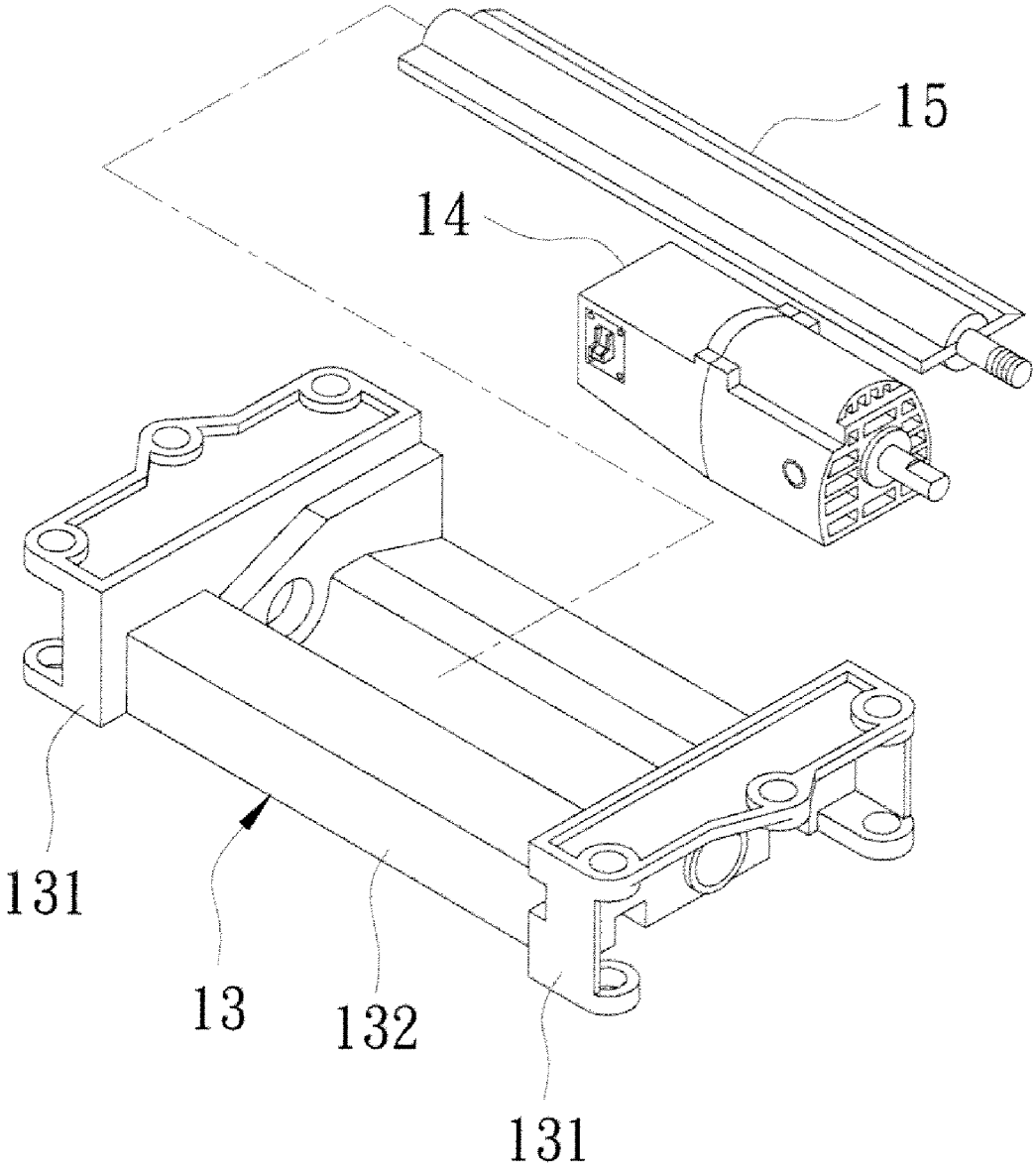
FIG. 2 PRIOR ART
FIG. 2 is an exploded view of a carrier of the conventional wood planer.
Figure 3:
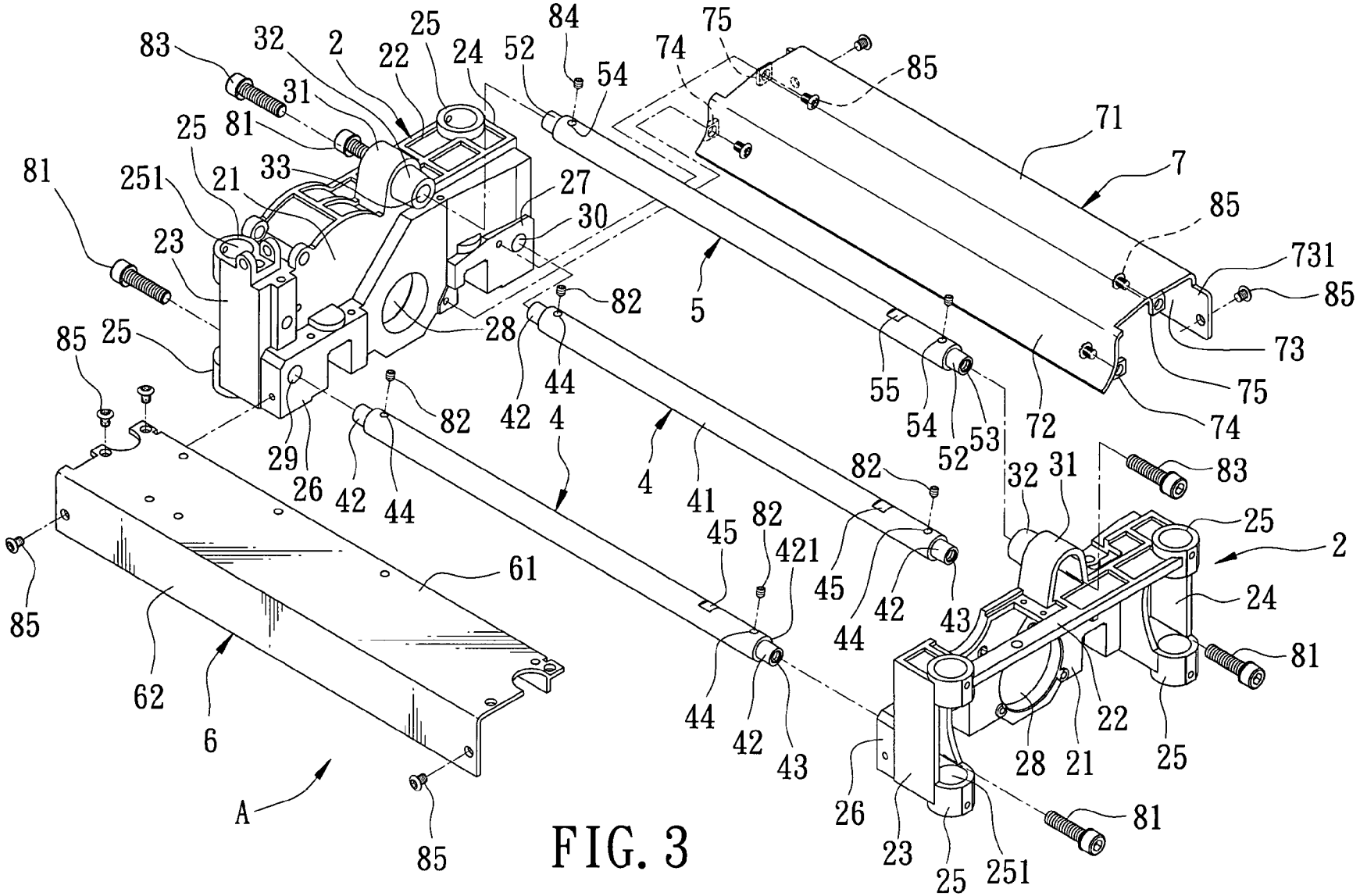
FIG. 3 is an exploded view of a preferred embodiment of the carrier according to the present invention.
Figure 4:
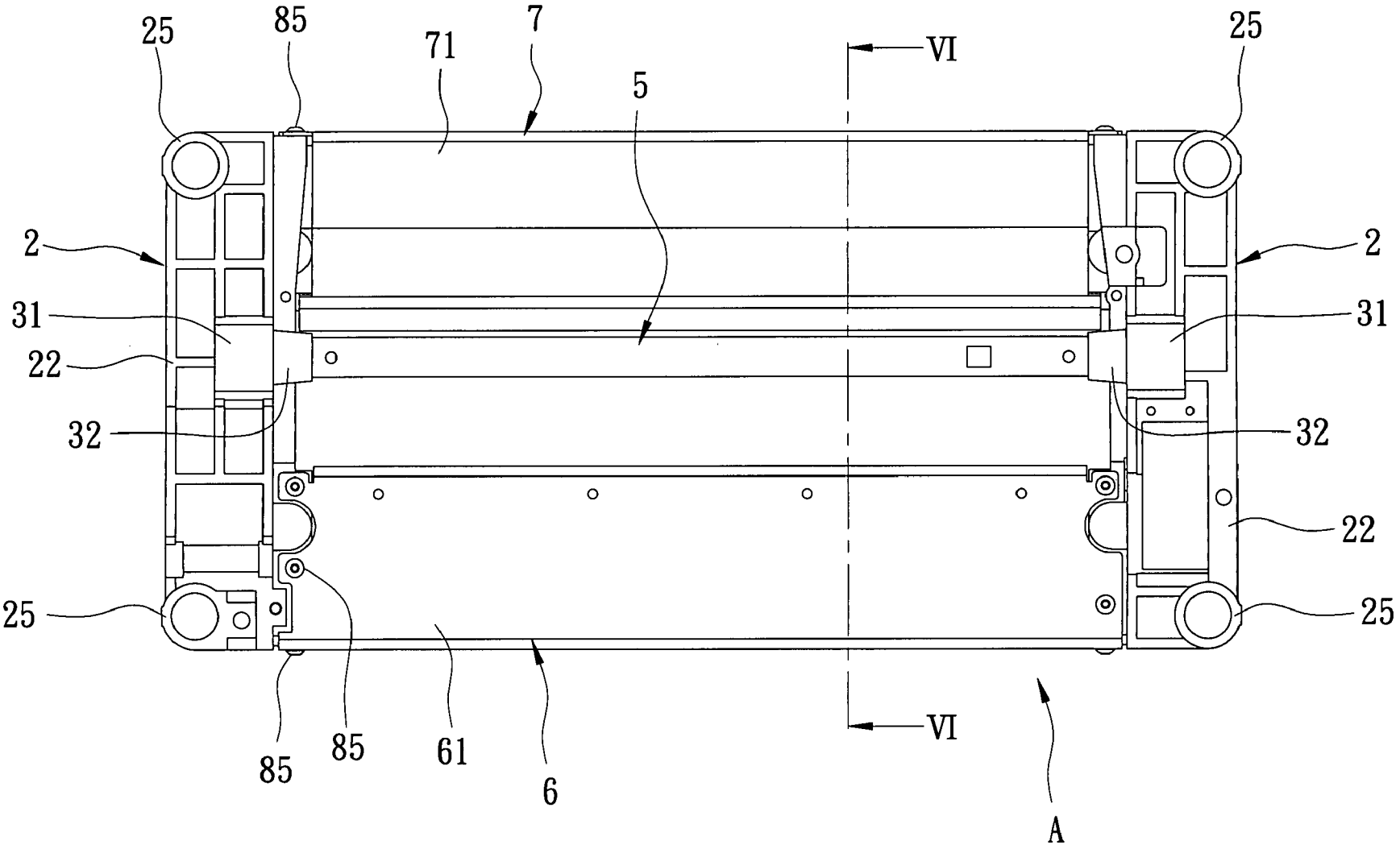
FIG. 4 is a top plan view of the preferred embodiment.

With the provision of the first connecting rods 4, the motor mounting plate 6, and the rear cover plate 7 disposed between the left and right mounting seats 2, and with the particular construction of the left and right mounting seats 2, the amount of material for making the carrier (A) is reduced, and the entire weight of the carrier (A) is relatively decreased compared to the conventional carrier 13 shown in FIGS. 1 and 2.

While the present invention has been described in connection with what is considered the most practical and preferred embodiments, it is understood that this invention is not limited to the disclosed embodiment but is intended to cover various arrangements included within the spirit and scope of the broadest interpretation so as to encompass all such modifications and equivalent arrangements.

I claim:

1. A carrier for a wood planer to carry a motor and a cutter and to move upward and downward along vertical guide posts, said carrier comprising:

left and right mounting seats each having front and rear support blocks, front and rear guide holes, and a cutter mounting hole adapted for mounting the cutter and disposed between said front and rear support blocks and between said front and rear guide holes, said front and rear support blocks projecting oppositely and inwardly from said left and right mounting seats, said front and rear guide holes being adapted for extension of the guide posts, a front connecting rod having left and right end sections respectively connected to said front support blocks of said left and right mounting seats;

a rear connecting rod having left and right end sections respectively connected to said rear support blocks of said left and right mounting seats;

a motor mounting plate disposed above said front connecting rod and having left and right ends respectively fixed to said front support blocks of said left and right mounting seats; and a top connecting rod having left and right end sections, said left and right mounting seats further having top ends which are provided with second insert holes, respectively, said left and right end sections of said top connecting rod being inserted into said second insert holes, respectively.

2. The carrier of claim 1, wherein each of said left and right mounting seats includes a base portion having a front end and a back end, a top portion having a front end and a back end, a front portion projecting between, and connected to, the front end of each of said base and top portions, and a rear portion projecting between, and connected to, the back end of each of said base and top portions, said front and rear portions each having, respectively, said front and rear support blocks projecting therefrom.

3. The carrier of claim 2, wherein said front and rear portions of said left and right mounting seats are provided with front and rear guide sleeves defining said front and rear guide holes.

4. The carrier of claim 2, wherein each of said left and right mounting seats further has two first insert holes one of which extends through said front support block and said front portion and the other one of which extends through said rear support block and said rear portion, each of said left and right end sections of each of said front and rear connecting rods being stepped and having an end neck, a shoulder adjacent to said end neck, a longitudinal screw hole extending longitudinally and opening at an end of said end neck, and a fastening screw, said end neck being inserted into one of said first insert holes of said left and right mounting seats, said fastening screw extending into said longitudinal screw hole to fasten a respective one of said left and right end sections to one of said front and rear portions.

5. The carrier of claim 4, wherein each of said left and right end sections of each of said front and rear connecting rods further has a transverse screw hole communicated with said longitudinal screw hole, and an abutment screw extending transversely through said transverse screw hole to abut against said fastening screw.

6. The carrier of claim 5, wherein each of said front and rear connecting rods further has an intermediate section with a rounded periphery between said left and right end sections, and two transversely opposite recessed flat faces formed in said rounded periphery.

7. The carrier of claim 1, wherein said motor mounting plate has a top plate portion extending above said front connecting rod, a front plate portion extending downwardly from said top plate portion in front of said front connecting rod, and screw fasteners to fasten said top and front plate portions to said front support blocks of said left and right mounting seats.

8. The carrier of claim 1, wherein said left and right end sections of said top connecting rod are stepped and each have an end neck inserted into one of said second insert holes.

9. A carrier for a wood planer to carry a motor and a cutter and to move upward and downward along vertical guide posts, said carrier comprising:

left and right mounting seats each having front and rear support blocks, front and rear guide holes, and a cutter mounting hole adapted for mounting the cutter and disposed between said front and rear support blocks and between said front and rear guide holes, said front and rear support blocks projecting oppositely and inwardly from said left and right mounting seats, said front and rear guide holes being adapted for extension of the guide posts, a front connecting rod having left and right end sections respectively connected to said front support blocks of said left and right mounting seats;

a rear connecting rod having left and right end sections respectively connected to said rear support blocks of said left and right mounting seats;

a motor mounting plate disposed above said front connecting rod and having left and right ends respectively fixed to said front support blocks of said left and right mounting seats; and a rear cover plate extending between said left and right mounting seats and fixed to said rear support blocks of said left and right mounting seats;

wherein said rear cover plate includes a top plate portion disposed above said rear connecting rod, a fence plate portion extending downwardly from said top plate portion in front of said rear connecting rod, and a back plate portion extending downwardly from said top plate portion behind said rear connecting rod.

10. the carrier of claim 9, wherein said read cover plate further includes first tabs projecting respectively and rearwardly from two ends of said fence plate portion, second tabs projecting respectively and downwardly from two ends of said top plate portion, third tabs projecting respectively from two ends of said back plate portion, and screw fasteners to fasten said first, second and third tabs to said rear support blocks.

* * * * *